US007644460B2

(12) United States Patent
Calvo

(10) Patent No.: US 7,644,460 B2
(45) Date of Patent: Jan. 12, 2010

(54) DEVICE AND METHOD FOR RELIEVING BACK PAIN

(76) Inventor: Orlando Calvo, Avenida 5B Sur #5, Marbella, Panama (PA)

( * ) Notice: Subject to any disclaimer, the term of this patent is extended or adjusted under 35 U.S.C. 154(b) by 168 days.

(21) Appl. No.: 11/707,308

(22) Filed: Feb. 16, 2007

(65) Prior Publication Data

US 2008/0092298 A1 Apr. 24, 2008

(51) Int. Cl.
*A47C 20/02* (2006.01)

(52) U.S. Cl. ..... 5/652; 5/640; 5/648

(58) Field of Classification Search ..... 5/624, 5/640, 648, 652

See application file for complete search history.

(56) References Cited

U.S. PATENT DOCUMENTS 2,502,752 A * 4/1950 Richards ..... 5/640
6,117,095 A * 9/2000 Daggett et al. ..... 602/19
6,957,463 B2 * 10/2005 Falwell ..... 5/648

* cited by examiner

*Primary Examiner*—Fredrick Conley
(74) *Attorney, Agent, or Firm*—Stroock & Stroock & Lavan LLP

(57) ABSTRACT

The present invention relates to an apparatus for relieving back pain, the apparatus having a top and a leg assembly for supporting the top when the apparatus is placed on a surface. A method of relieving back pain is also provided, wherein a user adjusts the height of an apparatus according to the user's buttock popliteus length, and lay on the surface and place his/her lower legs or feet on the top of an apparatus such that the knees are bent at substantially 90 degrees and his/her back is flat on the surface.

20 Claims, 3 Drawing Sheets

100
101
102
104
106
200
201
202
203
220
221
230a
230b
231a
231b
232a
232b
H1
H2
H3

100
102
104
106
120
296

DEVICE AND METHOD FOR RELIEVING BACK PAIN

BACKGROUND OF THE INVENTION

1. Field of Invention

The present invention relates to treatment of back ailments and, more particularly to a device and method for relieving back pain of persons of varying height.

2. Description of Related Art

It is well known that back pain is commonly experienced by people all around the world, and various methods of treatment are also well known, including different devices and mechanisms. However, these known devices typically have a fixed height, and the effectiveness of the methods and devices may vary by the height of the person.

Accordingly, it is desirable to provide a device for relieving back pain wherein the device is adjustable, and thus suitable for use by persons of different heights.

It is also desirable to provide a method of relieving back pain for persons of different heights using an adjustable apparatus.

SUMMARY OF THE INVENTION

A device for and a method of relieving back pain are provided. An exemplary embodiment of the invention provides a leg rest having an adjustable height for a user to support his/her legs while lying down on his/her back. The height can preferably be adjusted to permit the user's knees to be bent at a 90° angle.

Embodiments of the present invention also relate to a method of relieving back pain by elevating the feet while lying down, such that the user's thighs are at a 90° angle with respect to the user's back and calves, the calves and/or feet resting on a device having an adjustable height according to an embodiment of the present invention.

Other objects and features of the present invention will become apparent from the following detailed description, considered in conjunction with the accompanying drawing figures. It is to be understood, however, that the drawings are designed solely for the purpose of illustration and not as a definition of the limits of the invention, for which reference should be made to the appended claims.

BRIEF DESCRIPTION OF THE DRAWINGS

The particular features and advantages of the invention as well as other objects will become apparent from the following description taken in connection with the accompanying drawings, in which.

DESCRIPTION OF EMBODIMENTS

Figures 1, 2, 3:
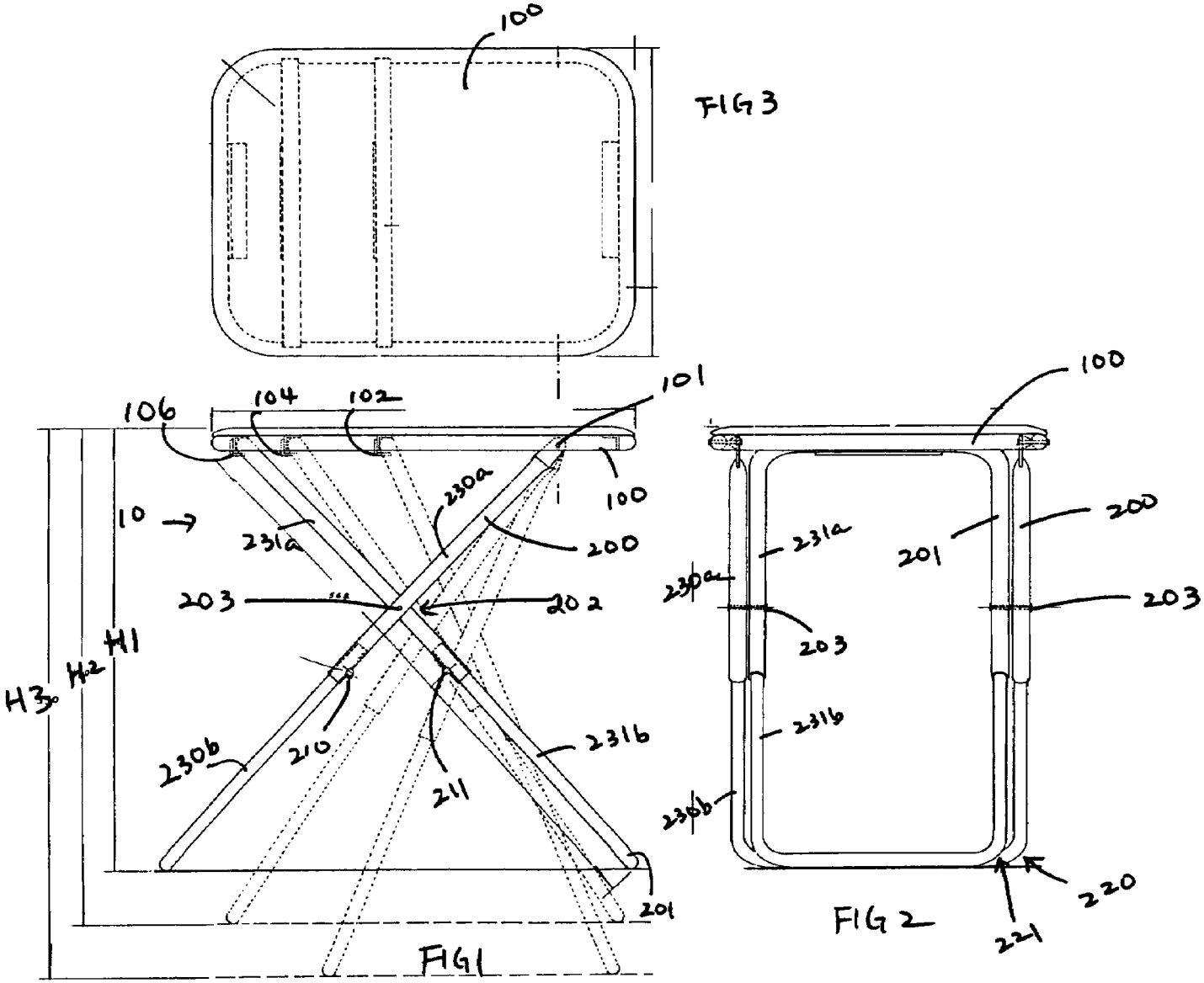
FIG. 1 is a side elevational view of a device in accordance with an embodiment of the invention.
FIG. 2 is a front elevational view of a device in accordance with an embodiment of the present invention.
FIG. 3 is a top planar view of a device in accordance with an embodiment of the present invention.
Figure 4:
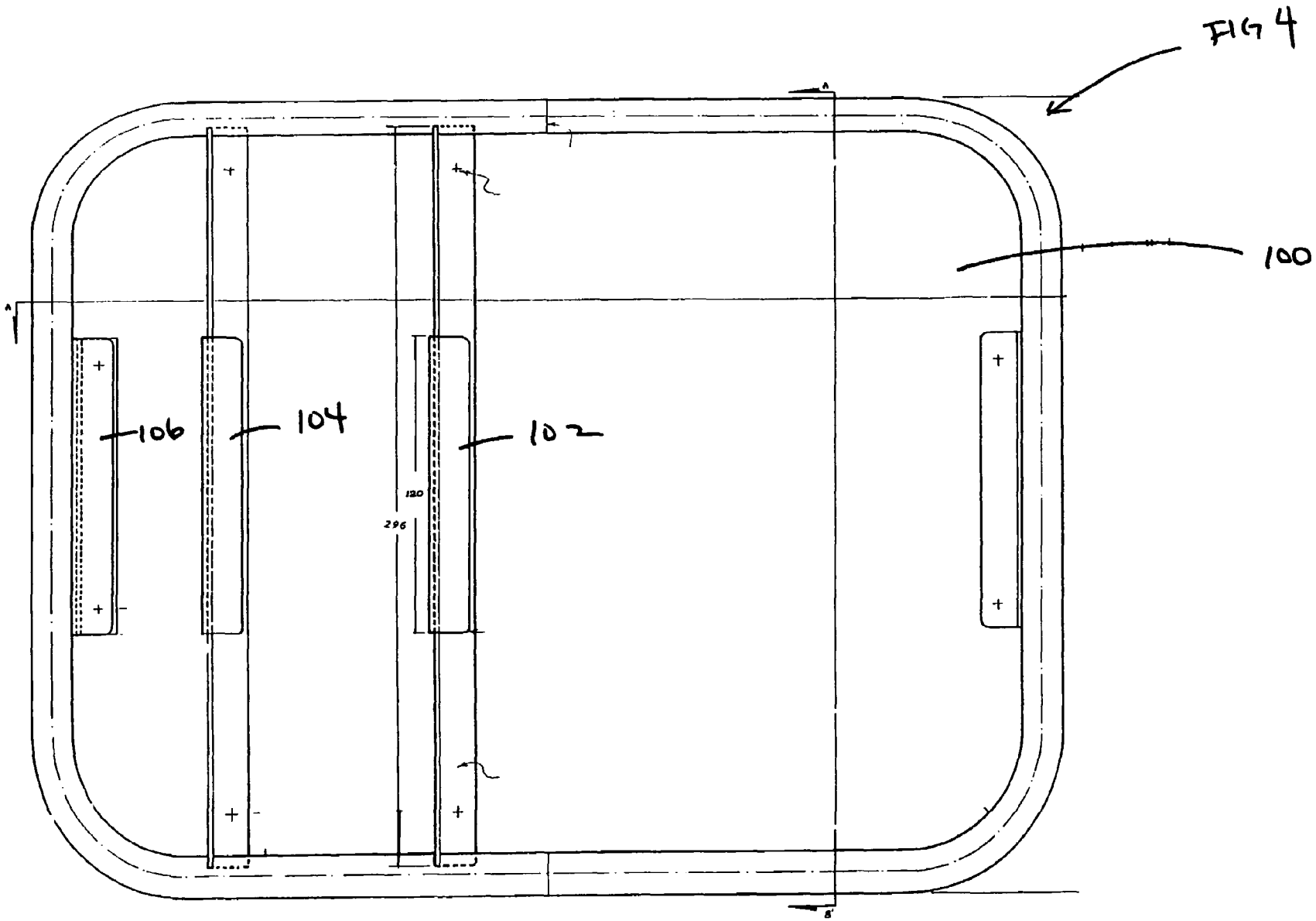
FIG. 4 is a bottom planar view of a top in accordance with an embodiment of the invention.
Figure 5:
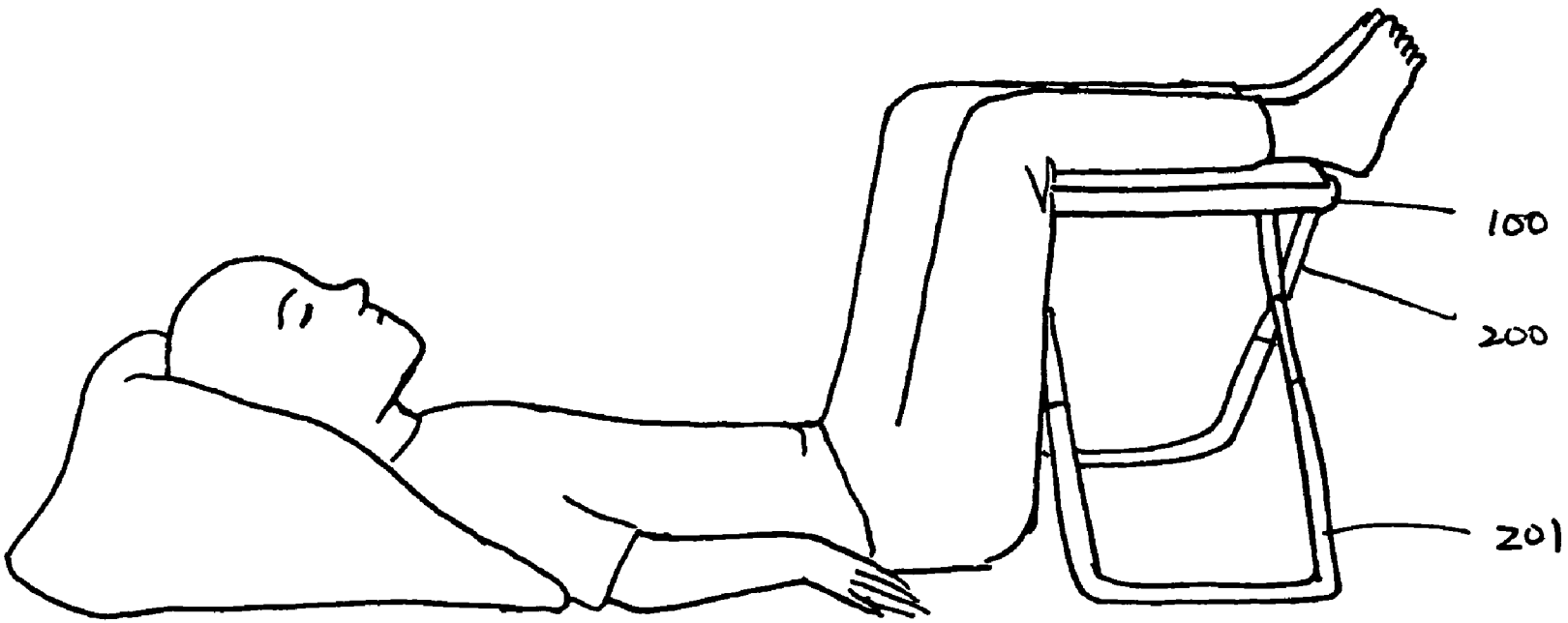
FIG. 5 is a side elevational view of a device being used in accordance with an embodiment of the present invention.

In accordance with an embodiment of the invention as shown in FIGS. 1-4, a device 10, referred to herein as a device, is constructed and arranged to support the legs and/or feet of a user to relieve back pain. Because people have different lengths of buttocks-popliteus lengths and because in accordance with an embodiment of the invention it is desirable to have users elevate their legs such that their knees are bent at a 90° angle with their thighs perpendicular to their backs (as shown in FIG. 5), a device in accordance with one exemplary embodiment of the invention is adjustable to be suitable for such users.

In general, the device 10 of the present embodiment comprises a top 100 substantially parallel to the surface on which it is placed, the top 100 supported by two legs 200, 201. In accordance with one embodiment of the invention, the user can lie on a flat surface, such as a bed, a floor, etc., and adjust the height of device 10 by altering the position of the legs 200, 201 with respect to the top 100. The user can place his/her lower leg or feet on top 100 while laying on the surface upon which device 10 is placed.

In accordance with an embodiment of the invention, device 10 is manufactured using a relatively light-weight material. By way of non-limiting example, device 10 or portions thereof can be constructed of aluminum. A light-weight material is preferable because it is common for persons suffering from back pain not to be able to lift heavy objects. Therefore, device 10 can be moved from place to place according to when and where the user wishes to use it.

Preferably, device 10 is foldable, which can facilitate transportation and storage. Top 100 preferably includes a relatively soft, cushioned material or layer 108 to provide comfort to the user.

The present illustrative embodiment of the invention comprises two legs 200, 201 although other number and arrangement of legs could be used. Legs 200, 201 comprise metal and be tubular having a hollow center. Legs 200, 201 can intercross and form an "x". Legs 200, 201 are preferably held together at an intersection 202 by a bolt 203 about which leg 201 can pivot with respect to leg 200. In accordance with the embodiment shown in FIGS. 1-4, leg 200 pivots about a bolt 101 in top 100. Therefore, the angle of leg 200 with respect to top 100 and leg 201 controls the height of device 10.

In accordance with the present exemplary embodiment of the invention, leg 201 has a length of about 56 cm, capable of adjusting the height of device 10 to a height of between about 60 cm and 30 cm, more preferably between about 53 cm and 43 cm. In accordance with this embodiment of the invention, a plurality of heights of device 10 is provided, preferably at 43 cm, 48 cm and 53 cm.

Top 100 preferably includes one or more stopping mechanisms for receiving the top of leg 201 (which in the present embodiment is parallel to the plane of the top 100), such as stoppers, brackets, detents, grooves, pins, strap(s) and other structures for receiving or stopping a portion of leg 201. As shown in FIGS. 1 and 4, top 100 includes a plurality of brackets 102, 104, 106. Brackets 102, 104, 106 are constructed and arranged to receive a top portion of leg 201, thus preventing the top of leg 201 from pivoting away from leg 200 any further and maintaining the height of device 10. As illustrated in FIG. 1, device 10 can provide a variety of heights H1, H2, H3, according to which bracket 106, 104, 102 is engaged by leg 201. Accordingly, the combination of the legs 200, 201 and the brackets 102, 104, 106 makes up a height adjusting assembly. Whereas three brackets and three heights are shown in FIG. 1, it is to be understood that the number of possible heights (as well as the actual heights provided) of device 10 can be altered without deviating from the scope of the invention. The device can include telescoping legs for adjusting the height, either in combination or in lieu of the pivoting arrangement shown in FIG. 1.

In accordance with an exemplary embodiment of the invention, a bracket 106 is located proximate one edge of top 100, wherein top 100 has a length of about 400 mm. Bracket 106 is located about 18 mm from the edge opposite hinge 101 to provide a first height H1 of device 10, and each of the other brackets 104, 102 is located progressively further away from the edge to provide a second H2 and third height H3 of device 10, greater than the first height. Additionally, brackets 104 and 102 can be about 69 mm and 157 mm from the edge of the top, respectively. When leg 201 engages bracket 106, the device has a height H1 of approximately 43 cm, when leg 201 engages bracket 104, the device has a height H2 of approximately 48 cm, and when leg 201 engages bracket 102, the device has a height H3 of approximately 53 cm.

Mass produced chairs available in the market are usually about 43 cm high. The median American male's popliteal height (the distance from the underside of the foot to the underside of the thigh at the knees when sitting) is 41.5 cm, and that of the median American female is 38 cm.

Because device 100 is preferably used by a user lying down with his/her thighs perpendicular to his/her back, the height of device 10 should accommodate at least approximately the buttock popliteal length of the user, i.e., the vertical distance from the rearmost part of the buttocks to the back of the knee. Statistically, less than 5% of males and females have a buttock popliteal length of 43 cm; 50% have less than 48 cm and 95% have less than 53 cm. Accordingly, it is preferable for device 10 to have at least one adjustable height of between approximately 35 cm and 55 cm. By way of non-limiting example, device 10 can be adjustable to three different heights: 43 cm, 48 cm and 53 cm corresponding to the three different brackets. However, it is to be understood that other heights can be used, and more or less variations in height can be provided by device 10 without deviating from the scope of the invention. Thus, devices according to the present invention may be sold in various sizes, for example, small, medium and large, with the different sizes having a generally progressive range of heights (e.g., small: 30-45 cm; medium: 40-55 cm; large: 50-60 cm).

Leg 200 is pivotable with respect to top 100 and leg 201 until leg 200 is parallel with top 100 and leg 201, thus permitting device 10 to be folded to facilitate storage and/or transport. In accordance with one embodiment of the invention, legs 200, 201 include a curved portion 220, 221 which can facilitate stabilizing device 10 on a surface, more particularly a soft surface such as a bed. For example, the soft surface can hug the curvature of curved portion 220, 221.

Furthermore, in the present embodiment, each leg 200, 201 comprises of generally two or more pieces whose ends are matable and telescoping, secured together by spring locks 210, 211 or other locking mechanism. Thus, leg 200 can be disassembled, removed, collapsed, retracted, etc. to facilitate storage or transportation. In the embodiment shown in FIG. 1, leg 200 includes two upper portions 230*a* which is pivotally attached to top 100, and a lower U-shaped portion 230*b*, which is maintained in position with respect to upper portion 230*a* via spring locks 210. Likewise, leg 201 includes a U-shaped upper portion 231*a* which is received by bracket 102, 104, 106 to adjust the height of device 10, and a U-shaped lower portion 231*b* maintained in position with respect to upper portion 231*a* via spring locks 211. In accordance with one embodiment of the invention, the lower portions 230*b*, 231*b* can be adjusted with respect to the upper portions 230*a*, 230*b*, for example, telescopically, to adjust the length of legs 200, 201. By providing legs of adjustable height, the range of heights of device 10 can be substantially increased. For example, if the legs have 3 different height settings, and the top has 3 brackets or other stopping mechanisms, the device could provide 9 different heights for the user to choose from. Such an arrangement can provide the user with narrower increments in height of device 10, thus providing a more tailored device for meeting the needs of the user.

Lower portions 230*b*, 231*b* is preferably removable from upper portions 230*a*, 231*a*, to facilitate storage or transportation of device 10 when not in use. Alternatively, lower portions 230*b*, 231*b* can be inserted into or receive upper portions 230*a*, 231*a* such that when collapsed, the legs 200, 201 do not extent beyond the length of top 100.

Additionally, a locking mechanism can be included for securing legs 200, 201 in the desired position, for example, at the selected height. By way of non-limiting example, a spring lock, clamp, strap, detent and other known locking mechanisms can be used.

It is to be understood that the examples provided are merely exemplary, as a matter of application specific to design choice, and should not be construed to limit the scope of the invention in any way.

Thus, while there have been shown and described and pointed out novel features of embodiments of the present invention, materials, dimensions, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall therebetween.

What is claimed is:

1. An apparatus to be placed on a surface, the apparatus for use by a user in relieving back pain by supporting the user's leg or foot, the apparatus comprising:

a top defining a plane, the top having a first stopper and a second stopper substantially within the plane; and a leg assembly constructed and arranged to support the top above the surface, wherein the top supports the leg or foot of the user laying on the surface;

the leg assembly having a first leg pivotally attached to a second leg, wherein the first leg can be pivoted between a first position in which the top is supported at a first height above the surface and a second position in which the top is supported at a second height above the surface;

the first leg including a first upper portion which contacts the first stopper when the first leg is in the first position, and which contacts the second stopper when the first leg is in the second position; and the second leg being movably attached to the top such that the top can be selectively positioned with respect to the leg assembly.

2. The apparatus of claim 1, wherein the first leg includes a first lower portion, and has a first length, the first upper portion selectively movable with respect to the first lower portion to adjust the length of the first leg.

3. The apparatus of claim 2, wherein the second leg includes a second upper portion and a second lower portion, the second leg having a second length, the second upper portion selectively movable with respect to the second lower portion to adjust the second length of the second leg, wherein the first length of the first leg and the second length of the second leg is adjustable between a first arrangement in which the top is supported at the first height when the first leg is in the first position, and a second arrangement in which the top is supported at a third height from above the surface.

4. The apparatus of claim 1 wherein the top has a top surface and a bottom surface and the stoppers are on the bottom surface.

5. An apparatus to be placed on a surface on which a user is to lie, the apparatus for supporting the legs or feet of the user to relieve back pain, the apparatus comprising:

a top defining a plane, the top having a first stopper and a second stopper substantially within the plane;

the first stopper and second stopper being spaced a distance apart;

a leg assembly having a displaceable leg displaceable with respect to the top; the displaceable leg having a first position in which the displaceable leg contacts the first stopper, and a second position in which the displaceable leg contacts the second stopper;

wherein the leg assembly is positioned beneath the top such that the leg assembly supports the top at a first height above the surface when the displaceable leg is in the first position and a second height above the surface when the displaceable leg is in the second position, the first height being different from the second height.

6. The apparatus of claim 5, wherein the top includes one or more stoppers for securing a portion of the leg assembly, wherein the stopping element determines the height.

7. The apparatus of claim 5, wherein the height is between 35 cm and 55 cm.

8. The apparatus of claim 5, wherein one of the plurality of heights is approximately 43 cm.

9. The apparatus of claim 5, wherein one of the plurality of heights is approximately 48 cm.

10. apparatus of claim 5, wherein one of the plurality of heights is approximately 53 cm.

11. apparatus of claim 5, wherein the apparatus is adjustable between three or more heights.

12. apparatus of claim 5, wherein the leg assembly includes a first leg pivotally attached to the top.

13. apparatus of claim 5, wherein the apparatus comprises aluminum.

14. apparatus of claim 5, wherein the apparatus comprises a spring lock constructed and arranged to secure the leg assembly.

15. The apparatus according to claim 5, wherein the leg assembly includes a first leg attached to a second leg, wherein the first leg can be pivotally moved to adjust the height.

16. apparatus of claim 5 wherein the top has a top surface and a bottom surface and the stoppers are on the bottom surface.

17. A method of relieving back pain of a user using an apparatus having a top that defines a plane and has a first stopper and a second stopper substantially within the plane, and a first leg and a second leg, having an adjustable height, the height being adjustable by positioning the first leg to contact the first stopper or the second stopper, the method comprising:

instructing the user to adjust the height of the apparatus to about buttocks popliteus length of the user by positioning the first leg at the first stopper or the second stopper;

instructing the user to lie down on a surface such that the user's back is substantially flat on the surface; and instructing the user to place the user's leg or foot on the apparatus such that the user's knee is at substantially a 90 degree angle and the user's thigh is substantially perpendicular to the surface.

18. A method of relieving back pain of a user having legs, the method comprising:

providing a height adjustable apparatus to support the user's legs, the apparatus having:

a top and a leg assembly, wherein:

the top defines a plane and has a first stopper and a second stopper substantially within the plane; and the leg assembly has a first leg with a first upper portion and a second leg with a second upper portion, the first leg being displaceable with respect to the top allowing the first upper portion to engage the first stopper to support the top at a first height, and engage the second stopper to support the top at a second height;

adjusting the height of the height adjustable apparatus to about the user's buttocks popliteus lengths by selectively engaging the first upper portion with one of the first stopper or second stopper;

laying the user on a surface such that the user's back is substantially flat on the surface;

placing the user's lower leg or foot on the apparatus such that the user's knee is at substantially a 90 degree angle;

wherein the user's thigh is substantially perpendicular to the surface and the user's lower leg is substantially parallel to the surface.

19. method of claim 18, wherein the apparatus comprises:

a top and a leg assembly;

wherein the leg assembly includes a height adjusting element to adjust the height of the top from the surface.

20. method of claim 18 wherein the top has a top surface and a bottom surface and the stoppers are on the bottom surface.

* * * * *